United States Patent [19]

Sandstrom et al.

[11] Patent Number: 4,636,168

[45] Date of Patent: Jan. 13, 1987

[54] APPARATUS FOR THERMAL AND PNEUMATIC TREATMENT OF GRANULAR SOLIDS

[75] Inventors: William A. Sandstrom, Chicago; Jitendra G. Patel, Bolingbrook, both of Ill.; John R. Bush, Dunwoody, Ga.

[73] Assignee: Institute of Gas Technology, Chicago, Ill.

[21] Appl. No.: 796,008

[22] Filed: Nov. 7, 1985

Related U.S. Application Data

[62] Division of Ser. No. 639,395, Aug. 10, 1984, Pat. No. 4,569,696.

[51] Int. Cl.[4] ..... F27B 15/00; B08B 7/04

[52] U.S. Cl. ..... 432/58; 34/211; 134/2; 134/19; 164/5

[58] Field of Search ..... 432/58, 15; 34/211; 110/245; 134/2, 19; 164/5

[56] References Cited

U.S. PATENT DOCUMENTS

| | | | |
|---|---|---|---|
| 2,478,461 | 8/1949 | Connolly | 134/2 |
| 2,650,084 | 8/1953 | White | 432/15 |
| 2,715,565 | 8/1955 | McKay | 432/58 |
| 2,813,318 | 11/1957 | Horth | 164/5 |
| 3,783,528 | 1/1974 | Sheely | 432/58 |
| 4,023,280 | 5/1977 | Schora et al. | 432/15 |
| 4,144,088 | 3/1979 | Adams | 134/2 |
| 4,427,372 | 1/1984 | Takesue et al. | 432/58 |
| 4,445,443 | 5/1984 | Stewart et al. | 432/58 |
| 4,478,572 | 10/1984 | Selli | 164/5 |
| 4,508,277 | 4/1985 | Andrews | 164/5 |

*Primary Examiner*—Henry C. Yuen

*Attorney, Agent, or Firm*—Thomas W. Speckman

[57] ABSTRACT

An apparatus for thermally and pneumatically treating granular solids to remove organic and inorganic chemical additives which are bonded to the granular solids or in admixture with them, to provide a purified granular solid product which is suitable for reuse, for example foundry sand for use in high strength molded cores, or for other productive uses, such as landfill. Granular solid feed material is preheated in a dilute phase zone of a fluidized bed, organic chemical additives are thermally oxidized in a dense phase zone of the fluidized bed, and remaining inorganic chemical additives are separated and removed from the granular solids in a contiguous pneumatic impaction zone. The purified granular solids are removed from the pneumatic impaction zone and organic and inorganic materials are elutriated from the fluidized bed and removed from the head space.

9 Claims, 2 Drawing Figures

APPARATUS FOR THERMAL AND PNEUMATIC TREATMENT OF GRANULAR SOLIDS

This is a divisional application of Ser. No. 639,395, filed Aug. 10, 1984, now U.S. Pat. No. 4,569,696.

BACKGROUND OF THE INVENTION

1. Field of the Invention

This invention relates to an apparatus for thermally and pneumatically treating granular solids to remove organic and inorganic materials which are bonded to the granular solids or in admixture with them to provide a purified granular solids product which is suitable for reuse in industrial processes or for other productive uses, such as landfill.

2. Description of the Prior Art

Granular solids are extensively used in industrial processes, particularly in the molding and casting of metals to be used as building materials and machine or equipment parts. Foundry sand comprises granular solids and is commonly used to make casting molds for metals. Various types of binders and hardeners, comprising organic and inorganic materials, are bonded to the foundry sand for use with different types of molds. It is important that the organic or inorganic material coats substantially the entire surface of each granular solid particle so that particles adhere to one another to form a strong mold. The organic bonding agents commonly used with foundry sand are natural drying oils and synthetic resins such as urea formaldehyde, phenol-formaldehyde, alkyd isocyanate, phenolic isocyanate, polyester urethane and furans with and without organic acids.

As the production of cast metal products has increased in recent years, consumption of foundry sand or suitable granular solids has increased and has made treatment enabling reuse of the solids important. The accumulation and disposal of waste solids also creates problems. Disposal of large quantities of used foundry sand or other granular solids is particularly difficult when the solids have been treated with harmful or toxic material. These waste solids can no longer simply be dumped or buried in view of stricter environmental standards enforcement. Reclamation of used granular solids provides: conservation of resources, environmental pollution control, and economy of operations.

Methods for reclaiming used granular solids can be generally categorized as wet reclamation, dry reclamation and thermal reclamation. In wet reclamation systems, the used granular solids are washed and agitated in an aqueous solution to rid the particles of chemical additives. Dry reclamation systems utilize scrubbing techniques to remove chemical additives. In thermal reclamation systems, the used granular solids are subjected to high temperatures where the chemical additives are thermally oxidized.

Thermal reclamation processes for removing organic and inorganic additives from granular solids, particularly foundry sand, have received considerable attention. Thermal reclamation processes utilize thermal energy to remove organic chemical additives from the used granular solids by thermal oxidation. Thermal treatment alone will not, generally, remove all inorganic chemical additives, such as bentonite and fine clays which are bonded to or mixed with the granular solids. These inorganic chemical contaminants must be removed by additional processing, usually by scrubbing, after the granular solids have been cooled. Thermal reclamation systems consume large quantities of energy and the reclamation processes have not been economically feasible, particularly in the United States.

Heat exchange techniques to reduce fuel consumption in thermal reclamation processes have been proposed. T. Itoh and N. Suzuki, "Low Energy Thermal Reclamation in Japan", AFS Transactions Vol. 88 (1980) proposes a heat exchanger to recover heat from particles exiting a single stage fluidized bed calciner. Alternatively, they propose a multi-compartment fluidized bed calciner in which sand, after it is calcined, is transferred to a lower chamber where heat is exchanged between the calcined sand and the incoming air. The Itoh et al reference teaches cooling the sand from 800° C. (1472° F.) to 500°-600° C. (932° to 1112° F.) in the lower, heat exchange chamber. The sand cooled in this manner is subsequently further cooled, and scrubbing and screening procedures are performed downstream from the fluidized bed calciner to remove any inorganic chemical additives. According to the Itoh et al reference, used sand is preheated to 700° C. (1292° F.) before it enters the fluidized bed calcining chamber.

Reclamation of used sand, particularly clay bonded sand and furan resin bonded sand in a fluidized bed roaster is reported by T. Watanabe et al, "Reclamation of Used Sand by Fluidized Bed Roaster", Mitsubishi Heavy Industries, Ltd., Technical Review 39 (February 1980). They observe that wet reclamation and dry reclamation methods alone are inadequate for foundry sand because residual organic chemical additives remain bonded to the foundry sand and cause casting defects and rough casting surfaces. Watanabe et al describe a fluidized bed roaster which removes substantially all organic chemical additives. The sand must, however, undergo further processing such as scrubbing, to remove inorganic chemical additives such as clay.

J. J. Geremia, "Thermal Sand Reclamation", AFS Current Information Report (1981) describes the process and suitable apparatus for thermal sand reclamation in a rotary kiln, a multiple hearth furnace, and a fluidized bed system. The fluidized bed calciner according to the Geremia reference comprises a calcining bed and one or more exchange beds for heat recovery. The multi-stage fluidized bed taught by Geremia requires a separate drying compartment for preheating the sand and incorporation of dry scrubbing techniques to remove inorganic chemical additives entailing the further steps of cooling the calcined sand and then subjecting it to pneumatic scrubbing in a separate, downstream pneumatic chamber.

U.S. Pat. No. 4,283,015 discloses an apparatus for removing No-Bake coatings from foundry sand by discharging the sand against a transverse target. Fines are separated and are entrained in an airstream while sand grains of desired particle size pass through the airstream and are recovered.

U.S. Pat. No. 2,478,461 teaches a method of scrubbing solids after they have been discharged from a furnace wherein sand is entrained in high velocity opposing air jets directed against one another so that non-carbonaceous materials are dislodged and removed.

U.S. Pat. No. 2,813,318 claims a method of removing carbonaceous as well as non-carbonaceous coatings from sand by impinging the sand entrained in an airstream against a fixed target.

U.S. Pat. No. 2,707,314 teaches a method for removing non-carbonaceous materials from decarbonized sand which utilizes a centrifugal flinger to impact sand against a rigid target with clean sand falling as a curtain through streams of air to remove foreign material.

U.S. Pat. Nos. 2,456,769, 2,547,587, 3,871,438, and 2,433,738, teach generally the removal of organic materials from foundry sand by burning.

SUMMARY OF THE INVENTION

The apparatus of the present invention utilizes a fluidized bed system wherein granular solids feed material is fed to and preheated in fluidized bed dilute phase above a denser phase fluidized bed wherein organic chemicals are thermally oxidized, and inorganic chemical additives are removed from the solid particles by means of pneumatic impaction below the denser phase fluidized bed concurrently with preheating of incoming gas by countercurrent passage of a portion of the incoming gas and the solids passing through the pneumatic impaction zone. The less dense and smaller inorganic particles are elutriated through the fluidized bed and freeboard space for removal while the purified more dense and larger granular solids are passed to a product solids collection vessel.

Granular solids feed material is introduced into a closed fluidized bed reactor above the denser phase fluidized bed and above or in the upper portion of the dilute phase fluidized bed. The granular solids feed falls through the dilute phase fluidized bed zone at a rate depending upon its density and particle size and the velocity of upward passing fluidizing gas. The dilute phase fluidized bed zone comprises a relatively dilute particle phase above the denser fluidized bed combustion zone. The dilute phase fluidized bed has a density of about 0.02 to about 0.05 lb/ft$^3$. Incoming granular solids are contacted and preheated by the upwardly flowing hot fluidizing gas. The granular solids feed need not be preheated nor predried as it is sufficiently preheated in the dilute phase fluidized bed zone of the reactor. The retention time in the dilute phase fluidized bed is suitably about 0.25 second to about 0.75 second, and preferably about 0.50 second to about 0.70 second to provide desired preheating of the solids by increasing their average temperature about 200° to about 500° F.

Granular solids which have been preheated in the dilute phase fluidized bed zone enter the denser phase fluidized bed combustion zone. It is recognized that there is a gradual transition between the dilute phase and denser phase fluidized bed zones. The dense phase fluidized bed has a density of about 50 to about 70 lb/ft$^3$. Temperatures in the denser phase fluidized bed are maintained at about 1000° to about 2000° F. by generalized combustion in the lower portion of the denser phase fluidized bed. Fuel for combustion is delivered to the lower portion of the denser phase fluidized bed and combusted by means well known in the art. Fluidizing gas is delivered to the lower portion of the fluidized bed and may pass through a bed support plate or other means for distributing the gas evenly across the cross section of the reactor. Suitable superficial gas velocities in the dense phase fluidized bed are about 1 to about 3 feet per second, preferably about 1.5 to about 2.5 feet per second.

Organic and inorganic oxidizable chemical materials, such as additives to foundry sands, are thermally oxidized in the dense phase fluidized bed. Retention time of solids in the dense phase fluidized bed is adjusted to ensure that the granular solids in the dense phase fluidized bed undergo desired thermal oxidation. Any non-oxidizable inorganic chemical material such as clay fines, bentonite, or dust, which is released from the solids during the thermal oxidation, is entrained in the fluidizing gas. The fluidizing gas and the entrained particles move upwardly through the denser fluidized bed zone, through the dilute fluidized bed zone preheating incoming granular solids and exit near the top of the fluidized bed reactor. This gaseous product with entrained particles may be conveyed to a gas/solids separator, such as a cyclone, and the flue gas and waste solids separately removed.

Solids treated by thermal oxidation are removed from the base of the dense phase fluidized bed and passed to a contiguous pneumatic physical impaction and heat recovery zone. In a preferred embodiment, the fluidized bed support plate converges to form a Venturi passageway through which granular solids from the dense phase fluidized bed zone are conveyed to the pneumatic impaction and thermal exchange zone.

Granular solids fall downwardly through the physical impaction and heat recovery zone countercurrently to incoming gas passing upwardly through the physical impaction and heat recovery zone. The solids are directed, by means of sequential baffles, allowing upward passage of gas, to nozzles. Gas is delivered through the nozzle and granular solids are entrained in the pressurized gas stream directed through the tapered end of the nozzle and impacted with high force on an impaction target. The impact of the granular solids on the impaction target physically dislodges any inorganic chemical material which adheres to the granular solids. A plurality of such baffle and nozzle pneumatic physical impaction zones may be arranged in vertical series with the solids falling by gravity from one to the next. From 1 to about 8 and preferably about 2 to about 6 of such physical impaction zones are suitable. The granular solids fall, by the force of gravity, from the last physical impaction zone and may be collected for reuse. Inorganic matter which is disloged from the granular solids upon pneumatic impaction is entrained in the upwardly flowing gas and is conveyed through the fluidized bed reactor and removed from the freeboard zone.

Thermal exchange between the downwardly flowing hot solids and upwardly flowing oxidizing/fluidizing gas occurs concurrently with physical impaction in the pneumatic impaction and heat recovery zone. The preheated oxidizing/fluidizing gas flows upwardly through the Venturi passageway and into the fluidized bed reactor. While gas is introduced through the solids entrainment nozzles for physical impaction, additional oxidizing/fluidizing gas may be introduced to the impaction-heat recovery zone to provide desired gas flow through the Venturi conduit to control solids withdrawal from the fluidized bed. The amount of gas introduced through the nozzles for pneumatic impaction should be less than two-thirds of the total gas passing through the fluidizing beds, about 40 to about 60 percent being preferred. The oxidizing/fluidizing gas passing through the impaction-heat recovery zone provides desired preheating of the gas by increasing its temperature about 800° to about 1100° F. while cooling product solids by at least about 100° F. and up to about 300° F. for discharge.

The apparatus of this invention removes both organic and inorganic chemical additives from granular solids in a single, continuous process providing concurrent pneumatic physical impaction and oxidizing/fluidizing gas preheat. The apparatus further provides preheating of the solids feed by the heated fluidizing gas passing from the denser combustion fluidized bed zone through a dilute phase fluidized bed zone to which the solids feed is introduced. Removal of substantially all additives is important when the granular solids are to be reused.

Granular solids which are reclaimed by the process of this invention may frequently be of higher quality than "new" granular solids. The thermal oxidation/-physical impaction apparatus tends to stabilize the particle, and reduce and clean the surface of individual solid particles so that better bonding of desired additives is achieved. Granular solids reclaimed using the apparatus of this invention are suitable for reuse in high strength molded cores or for other productive uses, and are environmentally "clean" for disposal such as landfill.

It is an object of this invention to provide a single continuous apparatus for removing a high degree of organic and inorganic chemical additives from treated granular solids to obtain a granular solids product which is suitable for reuse.

It is another object of this invention to provide a combined thermal oxidation/physical impaction solids reclamation apparatus which is energy efficient and economically feasible.

BRIEF DESCRIPTION OF THE DRAWING

The above mentioned and other additional features of this invention will become apparent, and the invention will be best understood by reference to the following description of preferred embodiments of the invention read in conjunction with the drawing wherein.

DESCRIPTION OF THE PREFERRED EMBODIMENTS

Figure 1:
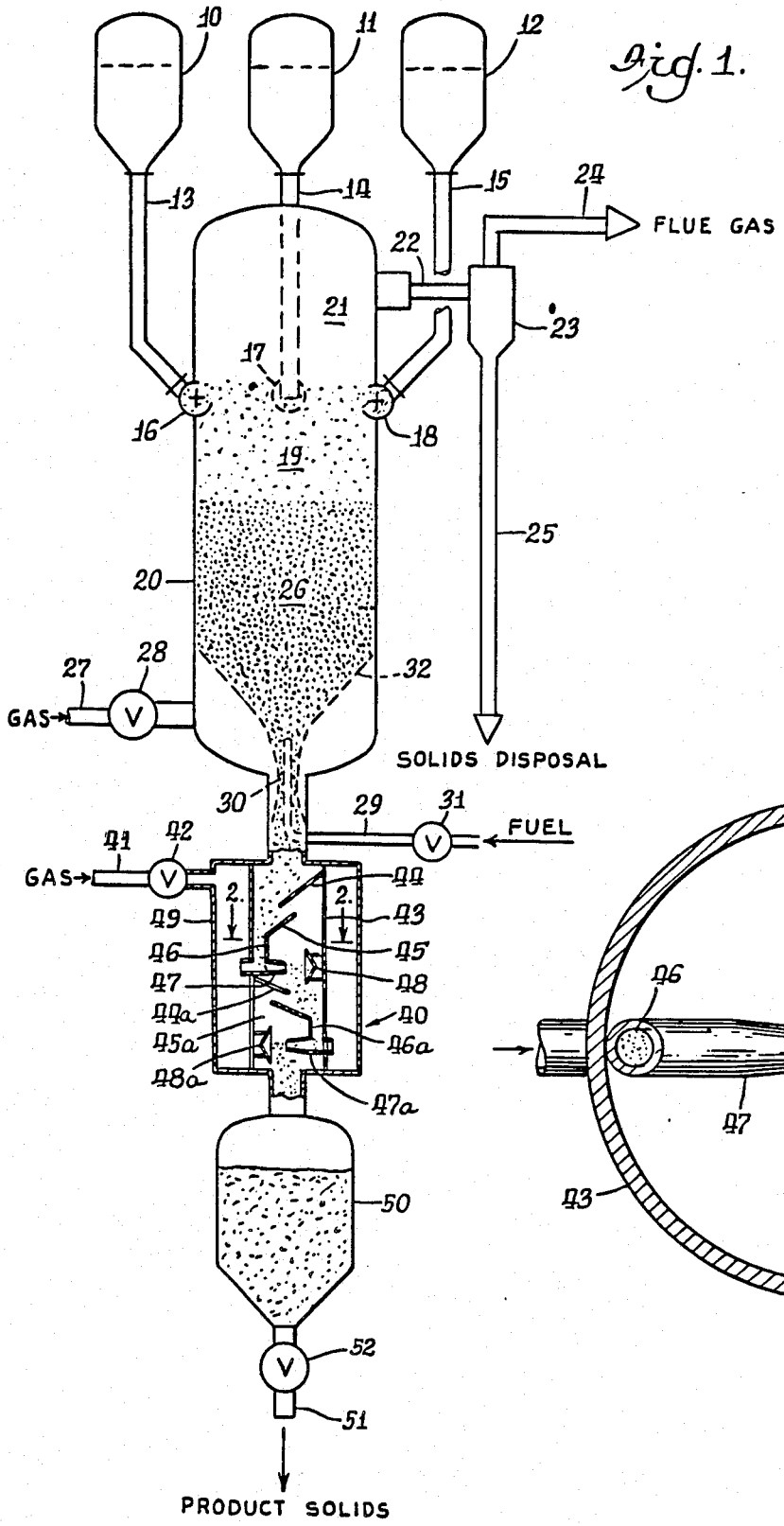
FIG. 1 is a schematic representation of a partially sectioned side view of one embodiment of an apparatus for carrying out the process of this invention.
Figure 2:
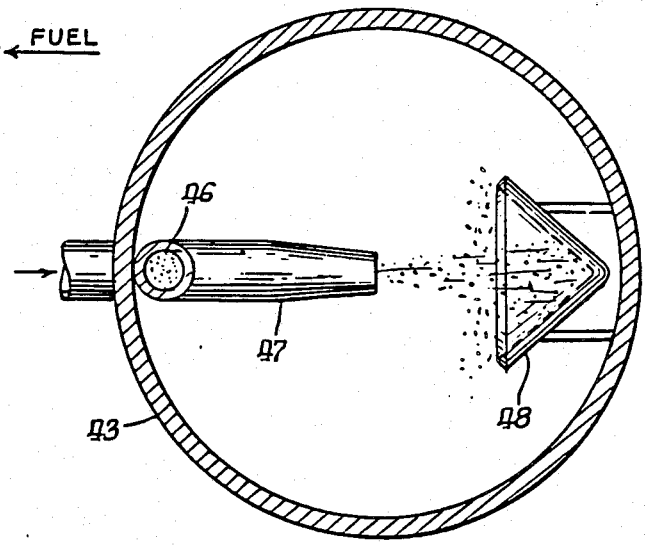
FIG. 2 is a view along line 2—2 in FIG. 1.

As shown in FIG. 1, granular solids feed material is delivered from solids feed bins 10, 11 and 12 of any compatible design, such as lockhoppers, through solids feed conduits 13, 14, and 15, to solids feed supply regulator-distributors 16, 17 and 18. Granular solids feed material comprises granular solids of approximately the size from about 0.1 mm to about 2.0 mm from which it is desired to remove organic and/or inorganic chemical materials. These may be additives which have been bonded to or reacted with the solids for any use, such as foundry sands, ore reduction intermediates, and fertilizers or granular solids in admixture with organic and/or inorganic contaminants. Solids feed supply regulator-distributors 16, 17 and 18 function to control the introduction rate and to distribute solids feed above or in the upper portion of dilute phase fluidized bed 19. The rate at which solids feed is introduced into fluidized bed reactor 20 is dependent upon the type of feed and desired retention time in the denser phase fluidized bed zone.

The construction and operation of fluidized bed reactors is well known and a variety of fluidized bed reactor configurations are suitable for use in this process. One preferred type of fluidized bed reactor has a Venturi conduit solids outlet for good separation of various size and density solids. Fluidized bed reactor 20 comprises at least three zones; freeboard zone 21 above dilute phase fluidized bed solids preheat zone 19 and denser phase fluidized bed thermal oxidation zone 26. Freeboard zone 21 must be of sufficient height to permit desired disentrainment of solids beneath gas withdrawal conduit 22. Dilute phase fluidized bed 19 is of suitable height to provide desired preheating of the solids feed, usually an increase in temperature of about 200° to about 500° F., preferably about 300° to about 400° F.

Granular solids which have been preheated in dilute phase fluidized bed solids preheat zone 19 enter lower denser fluidized bed thermal oxidation zone 26. Fluidization of the denser fluidized bed is maintained by fluidizing gas provided through conduit 27 and regulated by valve 28. Fluidizing gas is distributed by means of a fluidized bed support plate or grate 32. Fluidizing gas may be air or any other gas which facilitates combustion. Fuel is introduced to the lower portion of denser fluidized bed 26 through conduit 29 and is regulated by valve 31. The fuel may comprise any liquid or gaseous chemical mixture which will undergo combustion in the dense phase fluidized bed, preferably without liberating significant amounts of toxic by-products. Preheated oxygen containing gas for combustion is supplied through Venturi conduit 30.

The delivery of fuel and oxidizing/fluidizing gas is adjusted to maintain a temperature between about 1000° and about 2000° F., preferrably about 1200° to about 1600° F. in the dense phase fluidized bed. In addition to maintaining the preferable temperature range, it is preferable to assure complete combustion of the organic additives by providing an excess of oxygen above the stoichiometric requirement. It is preferred that the oxygen content of the gas leaving the reactor head space be about 2 to about 6 volume percent, with about 4 to about 6 volume percent being especially preferred. The highly mixed dense phase fluidized bed provides relatively uniform temperatures throughout the bed. Denser solid particles will tend to move toward the lower regions of the dense phase fluidized bed and are withdrawn through Venturi withdrawal conduit 30 while lighter solids and gases will tend to move toward the upper regions of the fluidized bed to be elutriated. The solid particles being treated are retained in the dense phase fluidized bed for a sufficient time to achieve the desired thermal oxidation. The retention of solids in the fluidized bed may be controlled by the velocity of upwardly passing gas through the Venturi and the size of the Venturi or by other flow control means known to the art. For reclamation of materials such as used foundry sand, we have found suitable retention times to be about 30 to about 90 minutes.

The thermally oxidized organic material, comprising gas and/or fine particles, is entrained in the fluidizing gas and moves generally upwardly through fluidized bed reactor 20 and exits through removal conduit 22. The gas with entrained particulate matter is conveyed to gas/solids separator 23 from which the particulate solids are discharged through conduit 25 and the gas is discharged through conduit 24 for disposal or further processing. The solids removed from gas/solids separator 23 may be discharged for disposal or further processing.

Granular solids subjected to desired thermal oxidation are controllably discharged from fluidized bed reactor 20 through Venturi passage 30 to pneumatic physical impaction and thermal recovery zone 40. The granular solids are directed through impaction zone flow conduit 43 by means of baffles 44 and 45 into conduit 46 which feeds into nozzle 47. Pressurized gas is supplied to nozzle 47 and the solids are entrained in the gas stream leaving nozzle 47 and directed toward physical impact target 48. Granular solids entrained in the gas stream are directed, at high velocity, against impaction target 48. Impaction target 48 is a rigid target which is fixed by means of supports to the wall of impaction zone flow conduit 43. The velocity of the gas stream is such that the granular solids are impacted, with considerable force, against impaction target 48 and inorganic with residual organic chemical materials, such as clays with organic resins which remain adhered to the surface of the granular solids following thermal oxidation, are dislodged and released upon impaction. Gas input to physical impaction and heat recovery zone 40 is supplied through conduit 41 regulated by valve 42 and enters manifold 49. Oxidizing/fluidizing gas supplied to manifold 49 may be air or oxygen enriched gas or other additives to promote combustion in the dense phase fluidized bed zone. Manifold 49 supplies gas to nozzles 47 and 47*a* and may supply additional gas to impaction zone flow conduit 43 as necessary to obtain desired downward flow of solids through Venturi conduit 30. The inorganic chemical materials which have been dislodged from the solid particles are entrained in the gas which flows upwardly past baffles 44 and 45 through pneumatic impaction and heat recovery zone 40, and through Venturi conduit 30 to enter fluidized bed reactor 20. As the gas passes upwardly through pneumatic impaction and heat recovery unit 40, considerable thermal exchange occurs between the upwardly flowing gas and the downwardly flowing granular solids thereby concurrently with pneumatic impaction preheating the gas before it enters fluidized bed reactor 20. Because the gas is preheated, less fuel is required to heat the fluidized bed to desired temperatures. The treated granular solids flowing downwardly through pneumatic impaction and heat recovery zone 40 are concomitantly cooled.

While FIG. 1 shows two pneumatic impaction stages, the numerals with an "a" suffix in the second stage referring to the same structure as the corresponding numeral in the first stage, the apparatus and process may have as many pneumatic impaction stages in series as is necessary to achieve desired freeing of foreign matter by pneumatic impaction. From 2 to about 8 such pneumatic impaction stages are suitable, about 3 to about 5 being most suitable for reclamation of foundry sands.

After undergoing pneumatic impaction, the product granular solids may be passed to collection chamber 50. Further heat recovery means may be incorporated prior to storage or reuse of the product granular solids. The product solids may be withdrawn from chamber 50 through product solids discharge conduit 51 controlled by valve 52.

The entire apparatus is preferably operated at about atmospheric or slightly negative pressure, about −1 to about +5 inches water being suitable. If desired to facilitate the reclamation process of this invention other chemicals may be added to the thermal oxidation zone which may also be operated at higher pressures.

The apparatus of this invention may be constructed of materials and components apparent to one skilled in the art upon reading this disclosure. Likewise, the specific design and sizing parameters of specific installations will be apparent to one skilled in the art upon reading this disclosure.

The following example is set forth as exemplary of one preferred embodiment of this invention and is not to be considered to limit the invention in any way.

EXAMPLE I

A two-phase fluidized bed was operated continuously for 24 hours reclaiming used foundry sand of the type utilizing organic bonding agents of natural drying oils and synthetic resins. During 6 of these hours granular solids feed of 98.8 weight percent sand and inorganic additive and 1.2 weight percent organic matter were fed to the reactor vessel at 1808 pounds/hour. The feed inlet was located in the upper portion of the dilute phase fluidized bed. The dilute phase fluidized bed had a density of about 0.05 lb/ft$^3$. The lower dense phase fluidized bed was maintained at 60.3 lb/ft$^3$ at a fluidized height of 2.8 feet. The fluidized bed was maintained at an average temperature of 1370° F. and the average reactor pressure was 12.6 psig. The pressure of 12.6 psig was necessary to accommodate the sampling system of the reactor used. Fluidizing gas having a composition of 75.8 percent $N_2$, 20.2 percent $O_2$ and 4 percent moisture was added through the fluidized bed support grid at the rate 28.3 mol/hr. The fluidized bed temperature was maintained by burning 100 percent methane added at the rate of 2.21 mol/hr. Oxidation/fluidization gas containing 75.8 weight percent $N_2$, 20.2 weight percent $O_2$, and 4.0 weight percent moisture was passed upwardly through the Venturi discharge conduit at 15.7 mol/hr. The average granular solid retention time in the fluidized bed was 47 minutes with the superficial velocity in the fluidized bed of 1.31 ft/s. From the above, it is seen that the oxygen/feed ratio (lb/lb) is 0.16 and the fuel/feed ratio (lb/lb) is 0.02.

The granular solid discharge was recorded at a rate of 1830 lb/hr with a composition of 0.19 weight percent carbon and 99.81 weight percent sand showing organics conversion of 81.12 percent.

The reactor head space gas composition was analyzed as 75.2 weight percent $N_2$, 7.1 weight percent $CO_2$, 6.8 weight percent $O_2$, and 11.5 weight percent moisture. The fines discharged from the reactor head space passed through three stages of cyclone separators to better illustrate size and composition ranges than use of a single stage as in normal practice. The first stage fines discharge composition was 2.59 weight percent C and 97.41 weight percent sand; the second stage fines discharge composition was 14.5 weight percent C and 85.55 weight percent clay; and the third stage fines discharge composition was 2.88 weight percent C and 97.12 weight percent clay. The feed, Venturi conduit discharge, first stage fines discharge, second stage fines discharge and third stages fines discharge, had the size distribution shown in Table I as weight percent.

TABLE I

| U.S. Sieve Size, | 12 | 20 | 30 | 40 | 50 | 70 | 100 | 140 | 200 | 230 | 270 | Pan | 50.8 μ | 40 μ | 20 μ | 10 μ | 5 μ | −5 μ |
|---|---|---|---|---|---|---|---|---|---|---|---|---|---|---|---|---|---|---|
| Feed | 0.0 | 0.1 | 0.1 | 2.7 | 23.6 | 56.6 | 15.4 | 0.8 | 0.4 | | 0.2 | 0.1 | | | | | | |
| Venturi Discharge | 0.0 | 0.1 | 0.1 | 3.1 | 24.5 | 55.4 | 15.1 | 0.7 | 0.5 | | 0.3 | 0.2 | | | | | | |
| 1st-Stage Fines | | | | | | | | 0.2 | 0.2 | 0.7 | | | 4.8 | 11.0 | 59.9 | 20.8 | 2.4 | 0.0 |
| 2nd-Stage Fines | | | | | | | | 0.3 | 0.3 | 0.3 | | | 0.3 | 1.0 | 19.0 | 42.1 | 34.0 | 2.7 |

TABLE I-continued

| U.S. Sieve Size, | 12 | 20 | 30 | 40 | 50 | 70 | 100 | 140 | 200 | 230 | 270 | Pan | 50.8 μ | 40 μ | 20 μ | 10 μ | 5 μ | −5 μ |
|---|---|---|---|---|---|---|---|---|---|---|---|---|---|---|---|---|---|---|
| 3rd-Stage Fines | | | | | | | | 0.2 | 0.0 | 0.2 | | | 0.1 | 0.2 | 0.6 | 2.9 | 56.8 | 39.0 |

The calcination stage results show excellent removal of both oxidizable organic matter and non-oxidizable matter from the used foundry sand. Results using another sample of the same type of used sand shows that calcining followed by a two stage scrubbing process reduces the residual clay content to an immeasurable amount on a double beam balance and also reduces by two-thirds the organic material remaining after calcining. The combined calcination-scrubbing stages according to this invention renders the reclaimed sand as suitable for use in coremaking as new lake sand.

EXAMPLES II–IV

The following three two-phases fluidized bed calcination runs with used foundry sand were made to show the dilute phase fluidized bed heat transfer from the upward flowing gases to the sand feed material fed through a single solids feeder to the upper portion of the dilute phase fluidized bed at ambient temperature. The conditions and results are shown in Table II:

TABLE II

| | Ex. II | Ex. III | Ex. IV |
|---|---|---|---|
| Sand Feed Rate (lb/hr) | 1808 | 1815 | 2392 |
| Sand Discharge Rate (lb/hr) | 1836 | 1802 | 2327 |
| Discharge Loss on Ignition (%) | 0.19 | 0.15 | 0.15 |
| Bed Height (Ft) | 2.8 | 2.5 | 2.7 |
| Bed Density (lb/ft$^3$) | 60.3 | 61.8 | 61.1 |
| Bed Temperature (°F.) | 1370 | 1359 | 1354 |
| Retention Time (Min.) | 47 | 43 | 35 |
| Air Feed Rate (lb/hr) | 1258 | 1257 | 1277 |
| Natural Gas Fuel (SCF/hr @ 1016 Btu/SCF) | 837 | 818 | 913 |
| Heat Input (Btu/Ton Sand) | 947,000 | 915,800 | 775,592 |
| Outlet Gas Composition (%) | | | |
| $N_2$ | 75.24 | 75.54 | 75.22 |
| $CO_2$ | 7.11 | 7.32 | 8.90 |
| $O_2$ | 6.17 | 6.41 | 4.70 |
| $H_2O$ | 11.48 | 10.73 | 11.18 |
| Outlet Gas Temperature (°F.) | 1119 | 1169 | 1059 |
| Outlet Gas Fines (lb/hr) | 6 | 6 | 6 |
| Reactor Pressure (psig) | 12.6 | 12.0 | 11.7 |

It is seen from the above Examples that the temperature of the gas is lowered in the dilute phase fluidized bed zone by amounts of 251°, 250° and 295° F., respectively. Use of multiple solids feeders would be expected to increase the thermal transfer.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of this invention.

We claim:

1. An apparatus for thermally and pneumatically treating granular solids to remove organic and inorganic materials therefrom comprising:

a reactor vessel capable of confining a freeboard zone, a dilute phase zone and a dense phase zone fluidized bed of said solids upon a bed support plate, said reactor vessel having a removal means for removing oxidizing/fluidizing gas entraining said organic and inorganic materials from said freeboard zone;

granular solids feed means capable of supplying said granular solids to be treated to said dilute phase zone;

heat means capable of maintaining said dense phase at about 1000° to about 2000° F. for thermal oxidation of said organic materials;

a contiguous pneumatic physical impaction flow conduit having an open upper end in communication with said dense phase zone fluidized bed and an opposite lower end in communication with a product granular solids withdrawal means, said flow conduit having baffle means directing said product granular solids to at least one nozzle and means for introducing pressurized oxidizing/fluidizing gas to said nozzle, each said nozzle being directed toward an impaction target for separation of said inorganic materials; and means for introducing and distributing oxidizing/fluidizing gas in quantities sufficient for conduct of said thermal oxidation and for maintenance of said fluidized bed in fluidized condition.

2. The apparatus of claim 1 wherein said contiguous pneumatic physical impaction and heat recovery zone comprises 1 to about 8 said nozzles arranged in series.

3. The apparatus of claim 1 wherein said contiguous pneumatic physical impaction and heat recovery zone comprises 2 to about 6 said nozzles arranged in series.

4. The apparatus of claim 1 further comprising a Venturi conduit in communication at its upper end with said dense phase fluidized bed and at its lower end with the upper end of said pneumatic physical impaction flow conduit.

5. The apparatus of claim 1 wherein said bed support plate slopes downwardly towards the upper end of said pneumatic physical impaction flow conduit.

6. The apparatus of claim 1 wherein said means for maintenance of said fluidized bed in fluidized condition comprises means for providing superficial gas velocity in said dense phase of about 1 to about 3 feet per second.

7. The apparatus of claim 1 wherein said means for introducing pressurized oxidizing/fluidizing gas to each said nozzle comprises means for regulating said gas to all of said nozzles to less than about two-thirds the total said gas passing through said bed.

8. The apparatus of claim 1 wherein said means for introducing and distributing oxidizing/fluidizing gas comprises means for said gas introduction to each said nozzle and to the lower portion of said reactor vessel below said fluidized bed.

9. The apparatus of claim 7 wherein said means for introducing and distributing oxidizing/fluidizing gas comprises means for said gas introduction to each said nozzle and to the lower portion of said reactor vessel below said fluidized bed.

* * * * *